US007284319B2

(12) United States Patent
Kato et al.

(10) Patent No.: US 7,284,319 B2
(45) Date of Patent: Oct. 23, 2007

(54) SELF-PIERCING RIVET SETTING DIE AND APPARATUS

(75) Inventors: Toru Kato, Toyohashi (JP); Hironori Umemura, Toyohashi (JP); Nobuharu Naitoh, Toyohashi (JP)

(73) Assignee: Newfrey LLC, Newark, DE (US)

( * ) Notice: Subject to any disclaimer, the term of this patent is extended or adjusted under 35 U.S.C. 154(b) by 543 days.

(21) Appl. No.: 10/909,782

(22) Filed: Jul. 30, 2004

(65) Prior Publication Data

US 2005/0086799 A1 Apr. 28, 2005

Related U.S. Application Data

(63) Continuation of application No. PCT/US03/03725, filed on Feb. 6, 2003.

(30) Foreign Application Priority Data

Feb. 8, 2002 (JP) ..... 2002-032538

(51) Int. Cl.

| | |
|---|---|
| ***B23P 21/00*** | (2006.01) |
| ***B21D 39/00*** | (2006.01) |
| ***B21D 15/10*** | (2006.01) |
| ***F16B 19/08*** | (2006.01) |
| ***F16B 37/04*** | (2006.01) |

(52) U.S. Cl. ..... 29/798; 29/524.1; 29/432.2; 29/243.53; 72/466.5; 411/179; 411/180; 411/501

(58) Field of Classification Search ..... 29/798, 29/524.1, 243.53, 432.2; 72/414, 466.5, 72/464, 358, 379.2; 411/501, 179, 181
See application file for complete search history.

(56) References Cited

U.S. PATENT DOCUMENTS 5,140,735 A * 8/1992 Ladouceur ..... 29/243.522
5,752,305 A 5/1998 Cotterill et al.
6,263,560 B1 * 7/2001 Edwards ..... 29/798
6,276,050 B1 8/2001 Mauer et al.
6,325,584 B1 * 12/2001 Marko et al. ..... 411/501
6,338,601 B1 1/2002 Mauer et al.
6,385,843 B1 5/2002 Singh et al.
6,546,613 B2 * 4/2003 Donovan ..... 29/524.1
6,763,568 B1 * 7/2004 Mauermann et al. ..... 29/432.2

(Continued)

FOREIGN PATENT DOCUMENTS

WO 03/020457 A1 3/2003

*Primary Examiner*—David P. Bryant
*Assistant Examiner*—Alexander P Taousakis
(74) *Attorney, Agent, or Firm*—Harness, Dickey & Pierce, P.L.C.

(57) ABSTRACT

A die (18) for use in a self-piercing rivet setting apparatus comprises a cavity (25) for receiving therein a protruded workpiece zone consisting of respective portions of the workpieces (2, 3) to be protrudingly deformed toward the die through the pressure of the self-piercing rivet (1). The cavity has a bottom surface provided with a central raised portion (29) protruding from the center of the bottom surface toward a punch. The central raised portion of the cavity has a vertical angle in the range of 90 to 160 degrees. Preferably, the central raised portion has a top formed in a spherical shape. The cavity has an approximately cylindrical outer wall (27) in the periphery thereof. The cavity has a curved inner surface extending from the top of the central raised portion to the lower end (33) of the outer wall through the bottom (35) of the cavity.

5 Claims, 6 Drawing Sheets

U.S. PATENT DOCUMENTS 6,802,682 B2 * 10/2004 Stevenson et al. ..... 411/501
6,814,531 B2 * 11/2004 Stevenson et al. ..... 411/501
6,910,263 B2 * 6/2005 Naito ..... 29/798
6,962,469 B2 * 11/2005 Wang et al. ..... 411/82
2003/0061698 A1 4/2003 Daehn
2004/0096296 A1 * 5/2004 Stevenson et al. ..... 411/501

* cited by examiner

SELF-PIERCING RIVET SETTING DIE AND APPARATUS

CROSS-REFERENCES TO RELATED APPLICATIONS

This application is a continuation of international patent application PCT/US2003/03725 which was filed on Feb. 6, 2003 designating the U.S., and which claims priority from Japanese patent application 2002-032538, filed on Feb. 8, 2002.

FIELD OF THE INVENTION

The present invention relates to a self-piercing rivet setting apparatus for setting in a plurality of workpieces a self-piercing rivet having a large-diameter head and a hollow leg extending downward from the head, and a die for use in the apparatus. More specifically, the present invention relates to a self-piercing rivet setting apparatus for connecting a plurality of workpieces with one another, such as two or more sheet members (or a sheet member and a component), by using a self-piercing rivet in a sheet-like metal assembling operation such as automobile assembling (particularly, an aluminum body assembling operation), and a die for use in the apparatus.

BACKGROUND OF THE INVENTION

In recent years, components that are made of an aluminum alloy have become more and more in use because weight reduction is required in transportation equipment and the like. Aluminum panels for an automobile and the like are not suitable for welding, and therefore are typically connected using self-piercing rivets.

One example of a self-piercing rivet setting apparatus is described in Japanese Patent Laid-Open Publication No. Hei 8-505087. The self-piercing rivet comprises a large-diameter head and a hollow leg extending downward from the head. When the self-piercing rivet is driven into workpieces, such as two body panels, by a punch and a die of the setting apparatus, the leg of the rivet is driven to pierce the workpieces while allowing the front end of the leg to be expandingly deformed, so as to connect the workpieces with one another by the deformed leg and the head.

Since the self-piercing rivet is driven to allow it to pass through a punch-side workpiece but to stay in a receiving-side workpiece adjacent to the die without passing therethrough, the rivet does not form any penetrating hole in the surface of the receiving-side workpiece. This provides an advantage of maintaining a sealing performance and good appearance of the receiving-side workpiece.

FIG. 1 shows a sectional view of the connecting portion of the workpieces connected by the conventional self-piercing rivet. The self-piercing rivet 1 comprises the large-diameter head 5 and the hollow leg 6 extending downward from the head. The self-piercing rivet 1 is driven into two workpieces 2 and 3 by the punch and the die (not shown) of the setting apparatus. At that time, the leg 6 of the rivet is driven to pierce the workpieces (such as the body panels) while allowing the front end of the leg 6 to be expandingly deformed, so as to connect the punch-side workpiece 2 and the receiving-side workpiece 3 by the deformed leg 6 and the large-diameter head 5.

In this conventional self-piercing-rivet driving operation, however, if the punch-side workpiece is thick and the receiving-side workpiece adjacent to the die is thin, then the leg of the rivet does not penetrate into the receiving-side workpiece adjacent to the die and consequently it is unable to provide a sufficient strength for the connection.

Also, in the conventional self-piercing-rivet driving operation, if more than two workpieces are to be connected, then the leg of the rivet does not penetrate sufficiently through the receiving-side workpiece adjacent to the die, and thereby it is difficult to reliably connect the workpieces together.

The present invention is directed to solve these problems, and therefore it is an object of the present invention to provide a setting apparatus capable of connecting workpieces by a self-piercing rivet, and a die for use in the apparatus, to achieve a sufficient connecting force.

Particularly, in the case of the receiving-side workpiece adjacent to the die is thin, it is also the object of the present invention to provide a setting apparatus capable of reliably connecting workpieces even in the case when more than two workpieces are connected, and a die for use in the apparatus.

SUMMARY OF THE INVENTION

The present invention relates to a die for use in a self-piercing rivet setting apparatus. This self-piercing rivet setting apparatus comprises a punch and the die for setting in a plurality of workpieces a self-piercing rivet having a large-diameter head and a hollow leg extending downward from the head. When the self-piercing rivet is driven into the workpieces, the leg of the self-piercing rivet is driven to pierce the workpieces while allowing the front end of the leg to be expandingly deformed in its radially outward direction and to be retained in the receiving-side workpiece without passing therethrough. The plurality of workpieces are then connected by the expanded leg and the head.

The die includes a cavity for receiving therein a protruded workpiece zone consisting of respective portions of the workpieces to be protrudingly deformed toward the die by the pressure of the self-piercing rivet.

The cavity has a bottom surface provided with a central raised portion protruding from the center of the bottom surface toward a punch. The central raised portion of the cavity has a vertical angle in the range of 90 to 160 degrees. Preferably, the central raised portion has a top formed in a spherical shape.

The cavity has an approximately cylindrical outer wall in the periphery thereof.

The outer wall of the cavity has an upper end with the inner diameter approximately equal to:

[the outer diameter of the leg of the rivet+the thickness of the receiving-side workpiece adjacent to the die×4], The cavity has a curved inner surface extending from the top of the central raised portion to the lower end of the outer wall through the bottom of the cavity.

Preferably, the upper end of the outer wall has a bevel or a radius which is very small.

Preferably, the outer wall of the cavity has an upper end having an inner diameter of:

[the outer diameter of the leg of the rivet+the thickness of the receiving-side workpiece adjacent to the die×4]±10%.

Also, the present invention is related to such a self-piercing rivet setting apparatus.

When the workpieces are connected by the self-piercing rivet using the above-described die, the central raised portion of the cavity allows the leg of the self-piercing rivet to be expandingly deformed in its radially outward direction while the self-piercing rivet penetrating into the workpieces. The material of the workpieces in the protruded workpiece zone flows along the central raised portion of the cavity in the radially outward direction thereof. The material of the workpieces in the protruded workpiece zone then flows along the curved inner surface of the cavity from the bottom toward the outer wall of the cavity, and flows upward along the outer wall of the cavity after changing its direction. Further, the material of the workpieces in the protruded workpiece zone flows toward the center of the cavity.

By the material flow described above, the receiving-side workpiece is squeezed at the upper part of the cavity, and thus an undercut is formed so that the workpieces can be connected reliably.

DETAILED DESCRIPTION OF THE PREFERRED EMBODIMENT

With reference to the drawings, an embodiment of the present invention will now be described.

Figure 2:
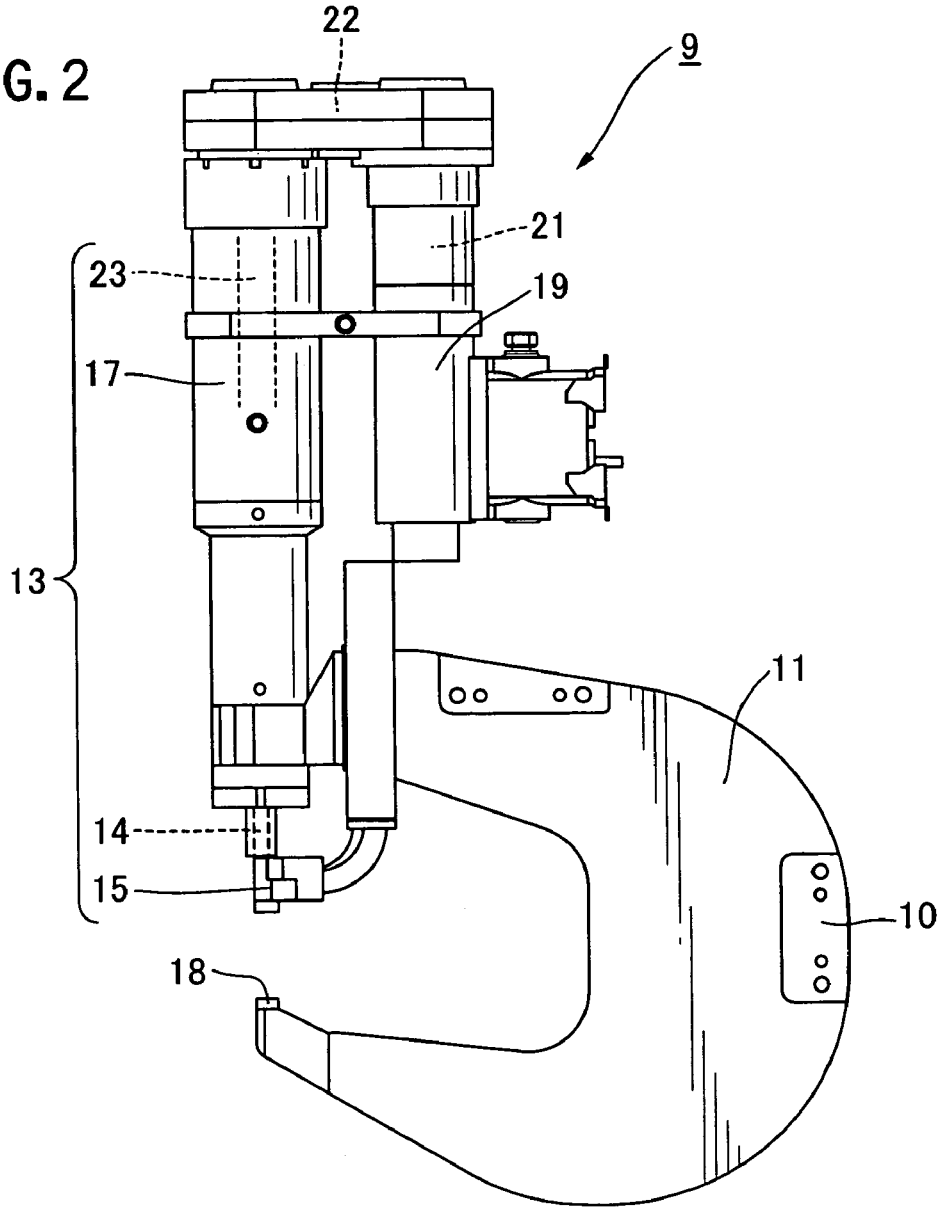
FIG. 2 is a front view of a self-piercing rivet setting apparatus according to one embodiment of the present invention.

FIG. 2 schematically shows the entire structure of a self-piercing rivet setting apparatus 9 according to one embodiment of the present invention. In FIG. 2, the self-piercing rivet setting apparatus 9 includes a C-shaped frame 11. The C-shaped frame 11 is an integral body including an upper horizontal arm region, a lower horizontal arm region, and a vertical arm region coupling the upper and lower horizontal arm regions. The C-shaped frame 11 can be deformed elastically to absorb an impact force during the rivet-driving operation. The vertical arm region of the C-shaped frame 11 has a coupling portion 10 to be coupled with an articulated robot arm (not shown). A setting mechanism 13 of the self-piercing rivet setting apparatus is attached to one end of the upper horizontal arm region. The setting mechanism 13 is provided with a punch 14 on the underside thereof attached movably in the vertical direction. A receiver unit 15 is provided further below the punch 14 to hold the self-piercing rivet.

A die 18 is attached to the end of the lower horizontal arm region of the C-shaped frame 11.

A spindle-driving unit 17 is provided above the punch 14. The spindle-driving unit 17 comprises an electric driving motor 19, a reduction gear mechanism 21 and a gear mechanism 22 for transmitting a rotation force of the motor, and a spindle 23 adapted to move vertically while rotating according to the rotation force from the gear mechanism 22. The spindle-driving unit 17 is operable to press the punch 14 downward so as to drive the self-piercing rivet 1 held in the receiver unit 15 on the underside of the punch into the workpieces held on the die 18.

Figure 1:
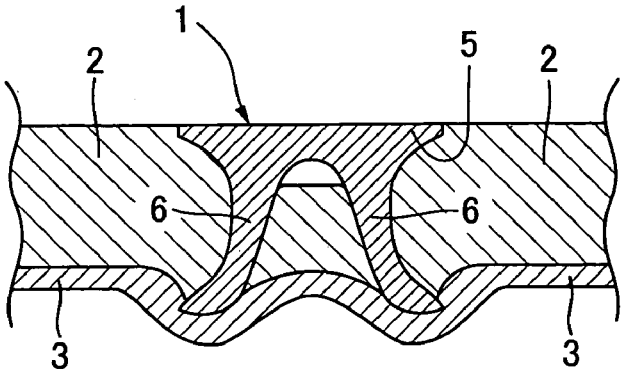
FIG. 1 is a sectional view showing connected workpieces with a self-piercing rivet driven by a conventional setting apparatus.

When the spindle 23 moves vertically according the rotation force of the electric driving motor 19, this movement is transmitted to the punch 14 which strongly presses the self-piercing rivet held in the receiver unit 15 toward the die 18. A plurality of workpieces (for example, see the workpieces 2 and 3 in FIG. 1) are placed on the die 18. According to the downward movement of the punch 14, the self-piercing rivet is driven into the plurality of workpieces. As a result, these workpieces are connected with each other.

Figure 3:
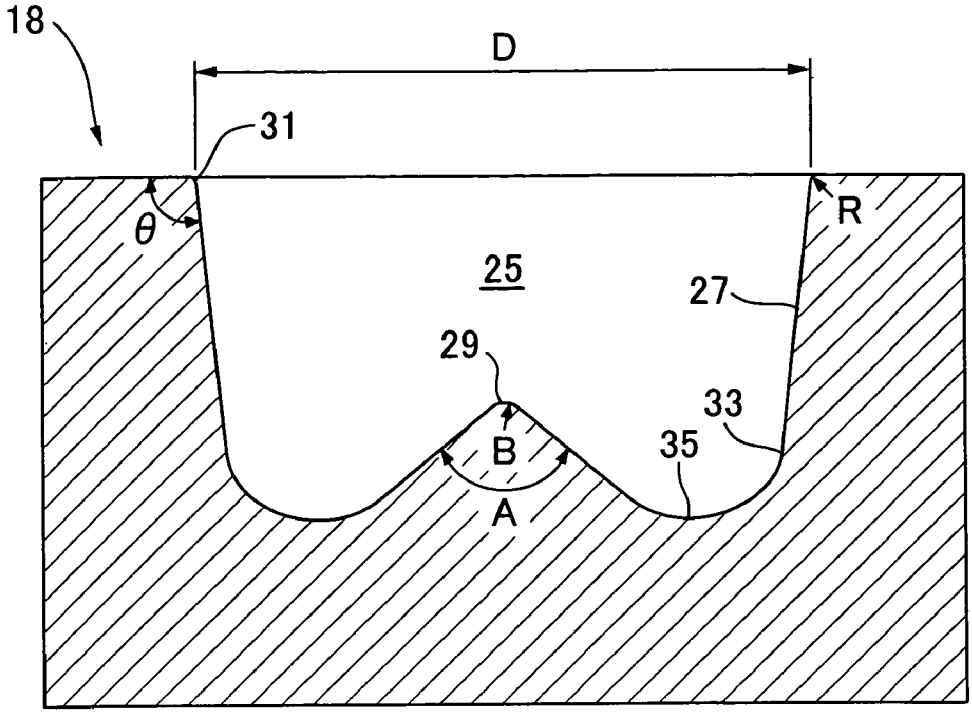
FIG. 3 is a sectional view of a die used in the self-piercing rivet setting apparatus in FIG. 2 according to the first embodiment of the present invention.

FIG. 3 shows the die 18 according to one embodiment of the present invention. The die 18 includes a cavity 25 having a specific configuration. When the self-piercing rivet is driven into the workpieces by the punch 14, the cavity 25 of the die 18 is adapted to receive therein the self-piercing rivet and the workpieces. The self-piercing rivet and the workpieces are deformed according to the shape of the inner surface of the cavity 25.

The cavity 25 is provided with a central raised portion 29. The leg 6 of the rivet 1 pressed by the punch is driven to pierce the workpieces while allowing a portion of the workpieces to be protrudingly deformed into the cavity 25. Since the cavity 25 has a bottom surface provided with the central raised portion 29 protruding from the center of the bottom surface, when the rivet 1 is driven into the workpieces, the leg 6 of the rivet 1 impinges on the central raised portion 29 unable to move in the straight downward direction, and therefore moves expandingly in its radially outward direction. Thus, due to the central raised portion 29, the leg 6 of the rivet is driven to pierce the workpieces while expanding in its radially outward direction. Therefore, the connecting strength of the workpieces is enhanced.

The angle A of the top of the central raised portion 29 is between 90 and 160 degrees inclusive. When the angle A is in this range, the material flow in the workpieces at the time of connecting operation is improved.

Also, the top of the central raised portion 29 preferably has a spherical shape with the radius of B. Making it spherical facilitates the material of the workpieces to flow in the outward direction.

In the cavity 25 is formed an approximately cylindrical outer wall 27. With the outer wall 27, the material of the workpieces flows upward along the outer wall 27.

In order to form the upward flow, it is preferred that the outer wall 27 has an upper end with the inner diameter D which is not too large compared with the outer diameter of the leg of the rivet. As an example, the upper inner diameter D of the outer wall 27 is:

> The upper inner diameter D of the outer wall=the outer diameter of the leg of the rivet+the thickness of the receiving-side workpiece adjacent to the die×4.

The material of the workpieces that has flowed upward along the outer wall 27 further flows toward the center of the cavity 25.

In this first embodiment, the outer wall 27 has the upper portion that has a larger diameter than the lower portion. Thus, θ>90 degree. By doing so, it is easier to remove connected workpieces from the die.

Also, the bevel or the radius R provided on the upper end 31 of the outer wall 27 of the cavity 25 is preferably made as small as possible.

Also, when the lower end of the straight line portion of the outer wall 27 of the cavity 25 is designated as 33, it is preferred that the cavity has a curved inner surface extending from the top of the central raised portion 29 to the lower end 33 of the outer wall 27 through the bottom 35 of the cavity.

When the inner surface of the cavity 25 has such a shape, the material of the workpieces flows outward by the central raised portion 29 toward the outer wall 27 through the bottom 35 of the cavity, and further flows upward along the outer wall 27 after changes its direction smoothly.

Figure 4:
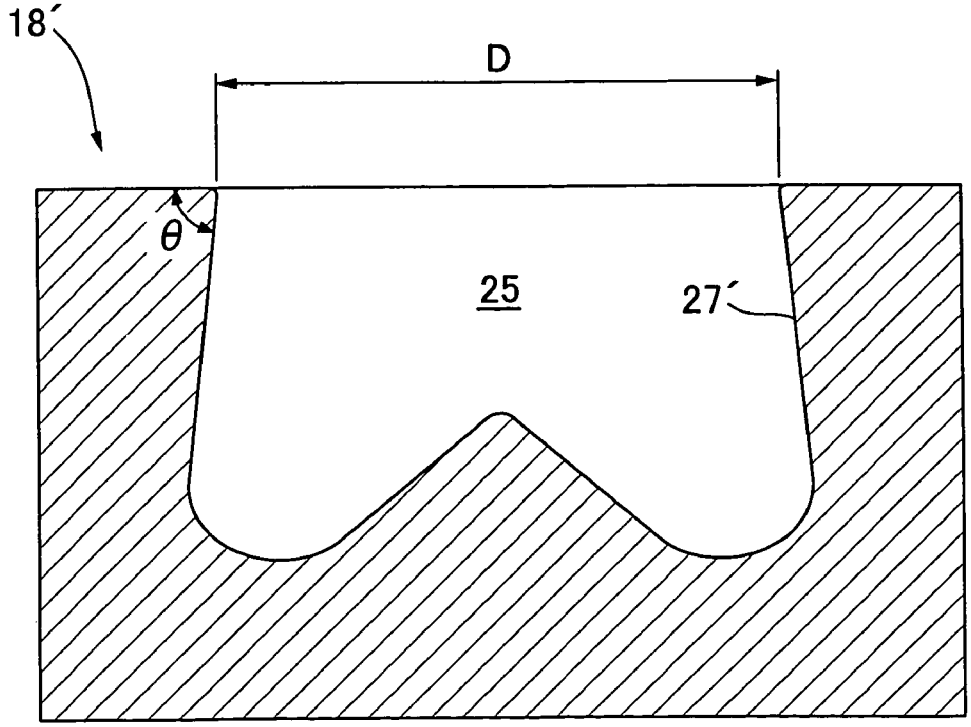
FIG. 4 is a sectional view of another die according to the second embodiment of the present invention.

FIG. 4 shows the die 18' according to the second embodiment of the present invention. In this second embodiment, the outer wall 27' has the upper portion which has a smaller diameter than the lower portion. Thus, θ<90 degree. Otherwise, the second embodiment is similar to the first embodiment. In the second embodiment, when the rivet connects the workpieces, the receiving-side workpiece adjacent to the die has a squeezed configuration in the upper part of the cavity, and thus the workpieces are connected more reliably than the first embodiment.

Figure 5:
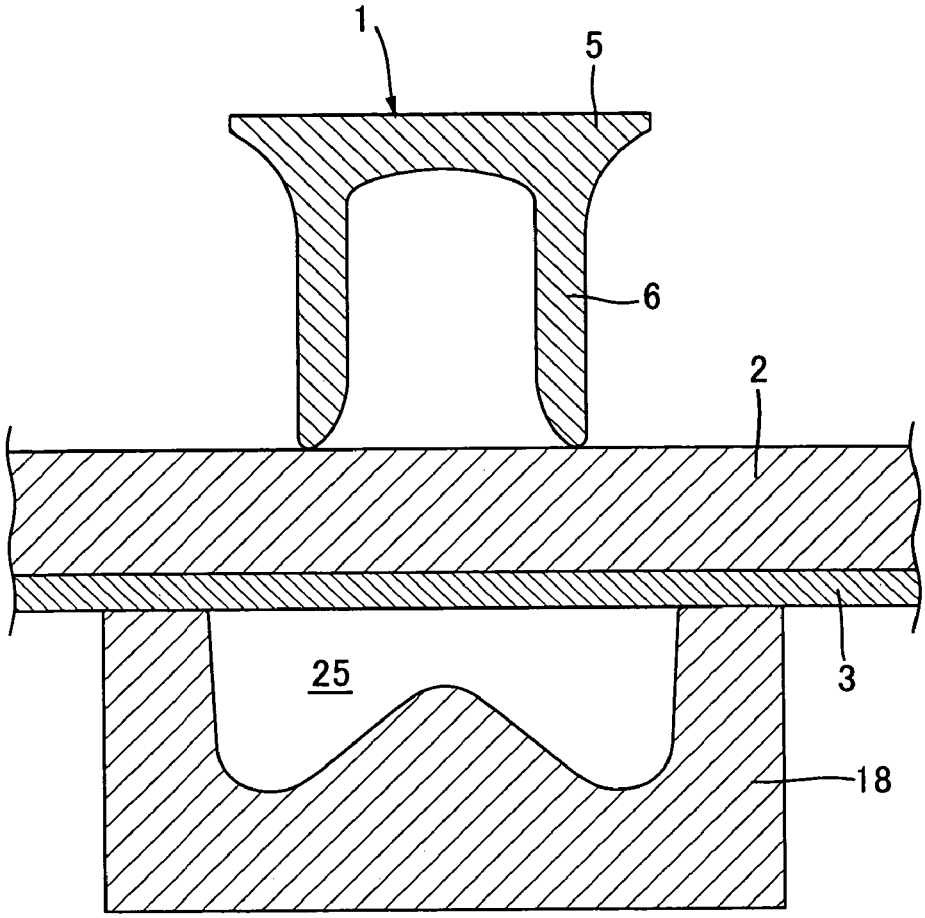
FIG. 5 is a sectional view of workpieces placed on a die before a self-piercing-rivet setting operation.

FIG. 5 is a sectional view illustrating the state when the workpieces 2 and 3 are placed on top of the other on the die 18 and before they are connected by the self-piercing rivet 1 according to the present invention. In the setting operation, the self-piercing rivet 1 is fed from a feeding unit (not shown) to the receiver unit 15, and held in the receiver unit 15 below the punch 14. Between the die 18 and the punch 14 are placed the workpieces 2 and 3.

Figure 6:
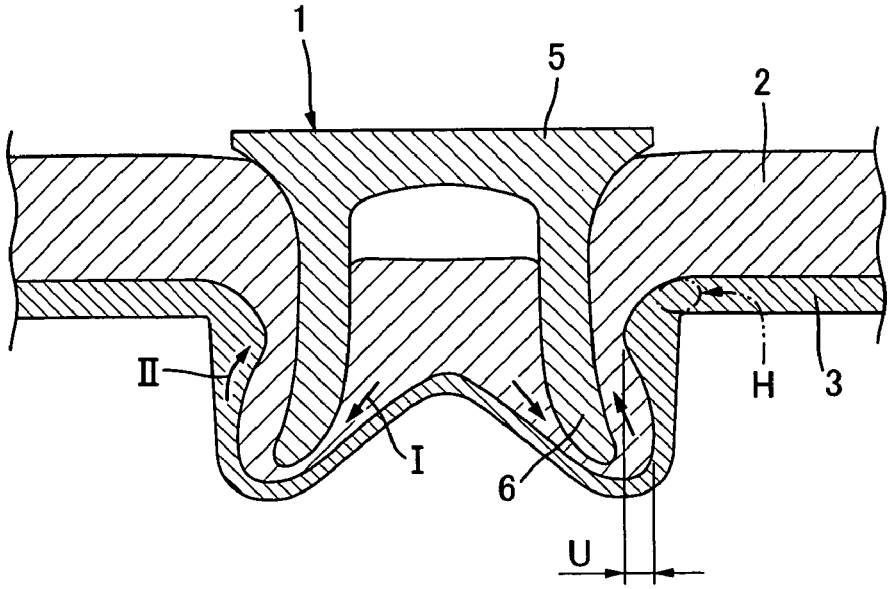
FIG. 6 is a sectional view of the workpieces during the self-piercing-rivet setting operation.

FIG. 6 is a sectional view illustrating the state before the completion of a self-piercing-rivet setting operation where the self-piercing rivet 1 is being pressed into the workpieces 2 and 3 placed on the die (not shown) by the punch (not shown) to connect the workpieces 2 and 3. The punch (not shown) is moved downward by receiving the pressing force from the spindle-driving unit 17 (FIG. 2) to drive the self-piercing rivet 1 into the punch-side workpiece 2. Through this rivet-driving operation, the hollow leg 6 of the self-piercing rivet 1 progressively pierces the workpiece 2. A portion of the workpieces 2 and 3 below the self-piercing rivet 1 is progressively deformed to protrude into the cavity 25 of the die 18. The receiving-side workpiece 3 progressively deforms and surrounds the punch-side workpiece 2.

Figure 7:
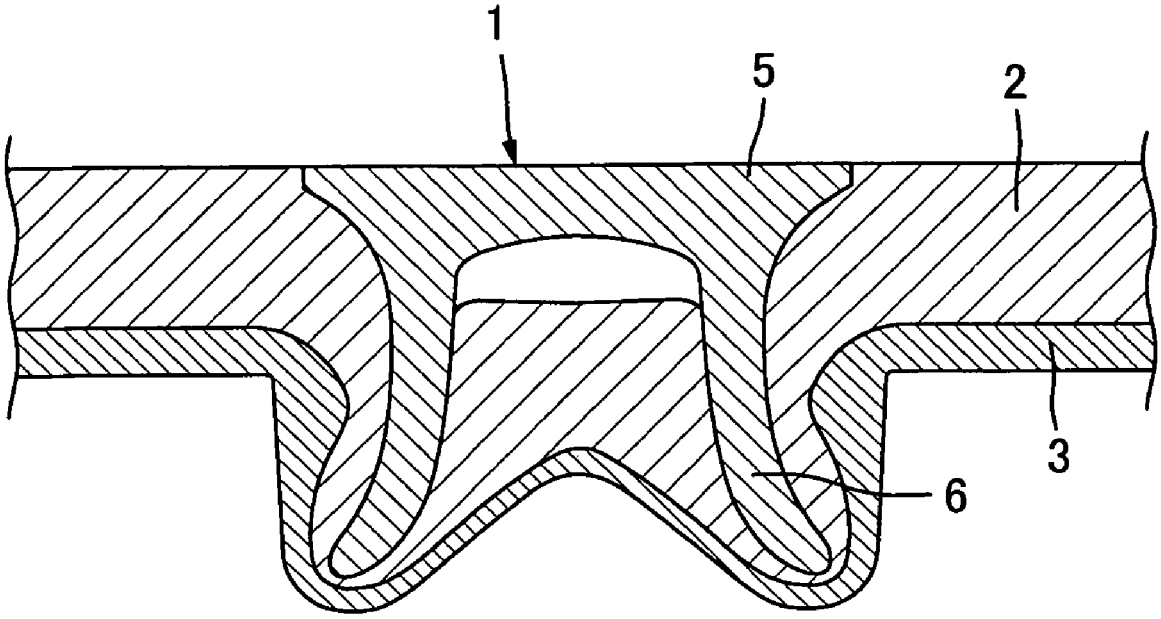
FIG. 7 is a sectional view of the workpieces after the self-piercing-rivet setting operation.

FIG. 7 is a sectional view illustrating the state where the workpieces 2 and 3 are connected. The receiving-side workpiece 3 is squeezed at the upper part of the cavity. This deformation allows the receiving-side workpiece 3 to be connected with the punch-side workpiece 2. The workpieces 2 and 3 removed from the cavity 25 are in the state that the workpieces are squeezed at the upper part of the cavity. Therefore, an undercut is formed after the connection has been made thereby maintaining the connection state of the workpieces 2 and 3.

Referring to FIGS. 3 and 6, the material flow in the workpieces 2 and 3 when the workpieces 2 and 3 are connected using the die of the present invention will now be described more in detail.

The angle A of the top of the central raised portion 29 of the cavity 25 is between 90 and 160 degrees inclusive. The angle A of the top in this range facilitates the flow of the material of the workpieces in the I direction along the central raised portion 29.

The top of the central raised portion 29 has a spherical shape with the radius of B. The top with the radius B facilitates the flow of the material of the workpieces that is trapped inside the rivet in the I direction shown in FIG. 6. The material of the workpieces flows in the I direction shown in FIG. 6 by the angle A and the radius B of the top.

The cavity 25 has the outer wall 27. The material of the punch-side and receiving-side workpieces flows outwardly and downwardly (the I direction) along the central raised portion 29, and the material of the workpieces further flows along the curved surface through the bottom 35 of the cavity 25 and, after changing its direction, flows in the upward direction along the outer wall 27.

The workpieces are pressed by the rivet from above direction. Also, by the rivet-driving operation, a portion of the workpieces that contacts to the periphery of the cavity of the die is crushed between the rivet and the die and work hardened (the H portion). Therefore, the material of the workpieces that has flowed upward along the outer wall 27 cannot move further upward, and thus flows in the direction toward the center of the cavity 25 (the II direction). As a result, the receiving-side workpiece will have a squeezed configuration in the upper part of the cavity, creating a protrusion 8 to form the undercut U.

It is preferred that the outer wall 27 has the upper inner diameter D which is not too large compared with the outer diameter of the leg of the rivet. As an example, the upper inner diameter D of the outer wall 27 is:

> the upper inner diameter D of the outer wall=the outer diameter of the leg of the rivet+the thickness of the receiving-side workpiece adjacent to the die×4.

When the upper inner diameter D of the outer wall 27 is maintained to be small, the outward extent of the material of the workpieces is constrained, creating the upward flow along the outer wall 27.

The bevel or the radius R provided on the upper end 31 of the outer wall 27 of the cavity 25 is preferably made as small as possible.

Also, it is preferred that the cavity has the curved inner surface extending from the top of the central raised portion 29 to the lower end 33 of the outer wall 27 through the bottom 35 of the cavity. When this portion of the inner surface has such a curved shape, the material of the workpieces will flow along the inner surface of the cavity by changing its direction smoothly from the I direction to the II direction.

Referring now to examples and comparisons, the present invention will be further described in detail.

COMPARISON 1

Figure 8:
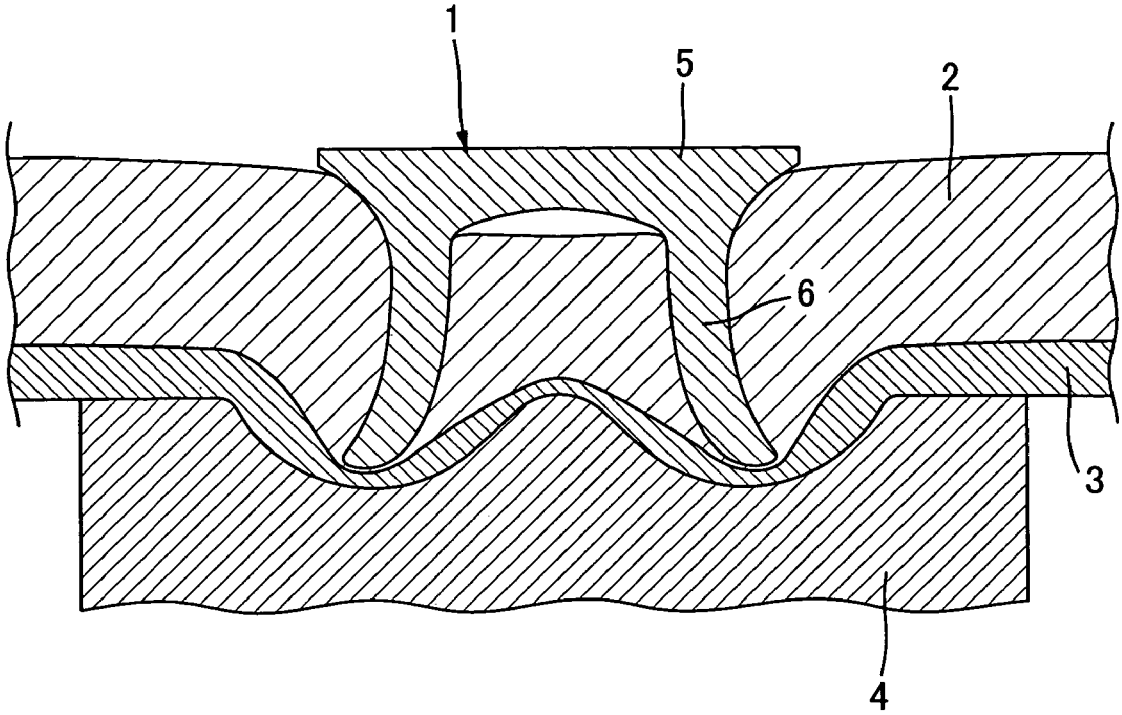
FIG. 8 is a sectional view showing the connected state of a thick workpiece and a thin workpiece with the self-piercing rivet using a conventional die.

FIG. 8 is a sectional view illustrating the state where a thick workpiece 2 and a thin receiving-side workpiece 3 are connected by the self-piercing rivet 1 using a conventional die 4. In this comparison. 1, after the thick workpiece 2 and the thin workpiece 3 are connected, the thin workpiece 3 is not squeezed at the upper part of the cavity thereby creating no undercut, and thus the workpieces 2 and 3 tend to separate at the interface therebetween.

EXAMPLE 1

Figure 9:
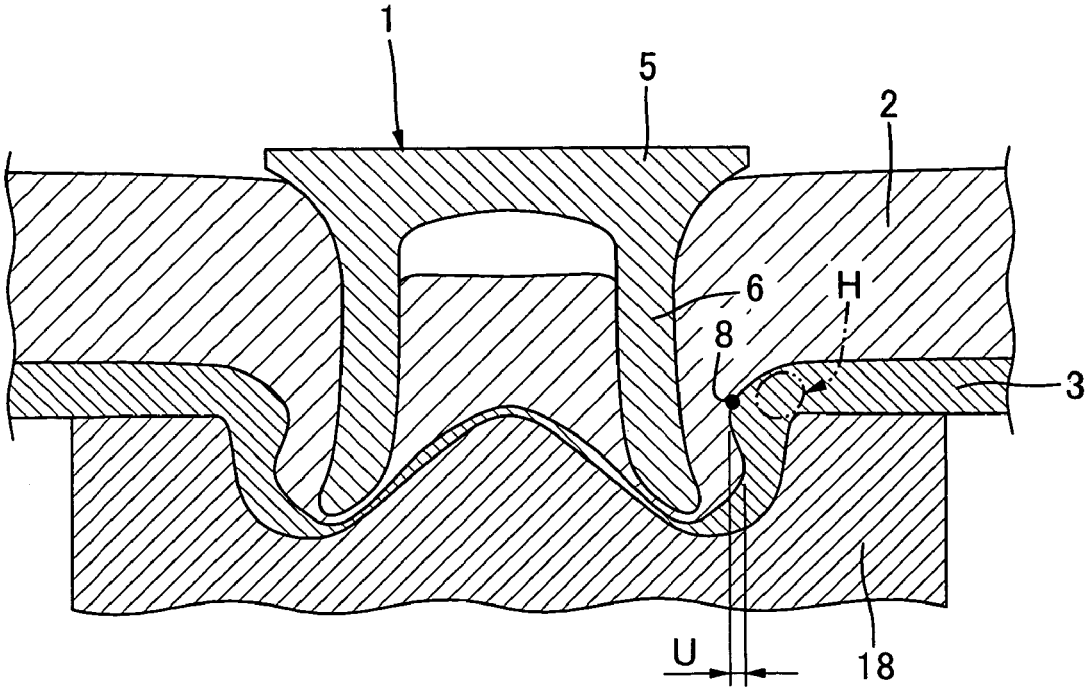
FIG. 9 is a sectional view showing the connected workpieces with the self-piercing rivet using the die according to the present invention.

FIG. 9 is a sectional view illustrating the state where the workpieces 2 and 3 are connected by the self-piercing rivet 1 using the die 18 according to the present invention. In Example 1, due to the shape of the cavity 25 of the die 18, the material of the workpieces flows well within the cavity 25. The receiving-side workpiece 3 has the squeezed configuration in the upper part of the cavity thereby creating the undercut, and thus the workpieces are reliably connected. As a result, the thick workpiece 2 and the thin receiving-side workpiece 3 are not easily separated.

COMPARISON 2

In Comparison 2, more than two workpieces are connected.

Figure 10:
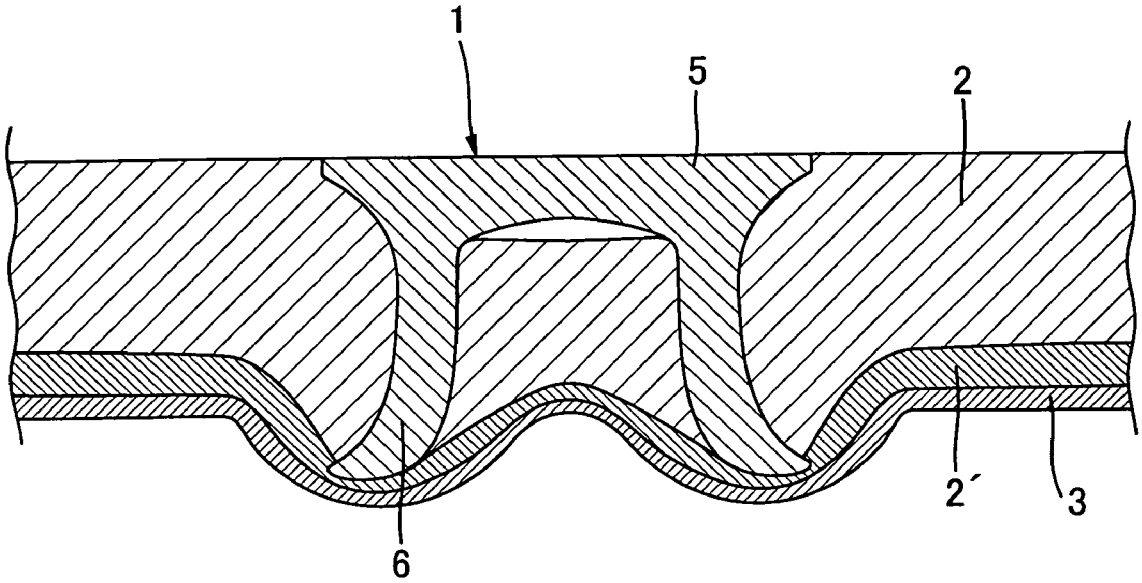
FIG. 10 is a sectional view showing the connected state of three workpieces with the self-piercing rivet using the conventional die.

FIG. 10 is a sectional view illustrating the state where three workpieces 2, 2', and 3 are connected by the self-piercing rivet 1 using the conventional die (not shown). In this example of prior art, the self-piercing rivet 1 does not penetrate through the receiving-side workpiece 3 and therefore a separation tends to occur between the intermediate workpiece 2' and the receiving-side workpiece 3.

EXAMPLE 2

Figure 11:
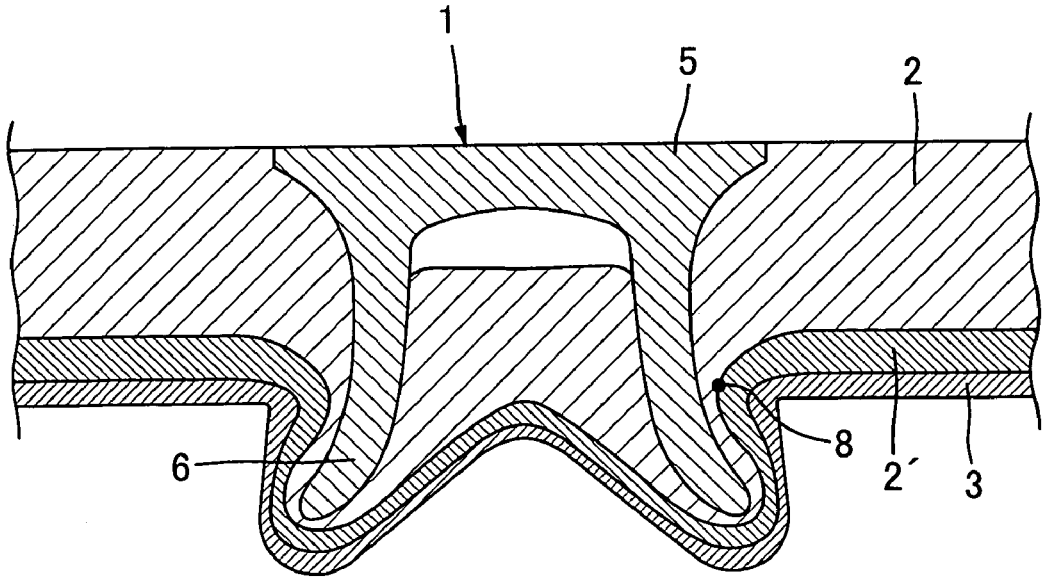
FIG. 11 is a sectional view showing the connected state of three workpieces with the self-piercing rivet using the die according to the present invention.

FIG. 11 is a sectional view illustrating the state where three workpieces 2, 2', and 3 are connected by the self-piercing rivet 1 using the die according to the present invention. In Example 2, the receiving-side workpiece 3 is squeezed at the upper part of the cavity and thus the undercut is formed. Therefore, after the workpieces are connected, the receiving-side workpiece will not separate from the interface therebetween.

As described above, when the workpieces are connected by the self-piercing rivet using the die according to the present invention, a smooth flow of the material of the workpieces can be formed upon connecting the workpieces, and as a result the receiving-side workpiece has the squeezed configuration in the upper part of the cavity, thereby creating the undercut. Therefore, the workpieces can be connected more reliably than the case where the self-piercing rivet connects the workpieces using the conventional die.

In particular, when the receiving-side workpiece is thinner than the punch-side workpiece or when more than two workpieces are connected, even in such cases, a plurality of workpieces can be connected reliably.

We claim:

1. A die for use in a self-piercing rivet setting apparatus having a punch and the die which are operable to drive a self-piercing rivet into a plurality of workpieces positioned between the punch and die, said self-piercing rivet having a large-diameter head and a hollow leg extending downward from said head, wherein when said self-piercing rivet is driven into said workpieces, said leg of said self-piercing rivet is driven to pierce said workpieces while allowing a front end of said leg to be expandingly deformed in its radially outward direction and to be retained in said workpieces without passing therethrough, so as to connect said plurality of workpieces with each other by said expanded leg and said head, said die comprising:

a cavity for receiving therein a protruded workpiece zone consisting of respective portions of said workpieces to be protrudingly deformed toward said die through the pressure of said self-piercing rivet pressed by said punch, wherein said cavity has a bottom surface provided with a central raised portion protruding from the center of the bottom surface toward a punch, said central raised portion of the cavity having a vertical angle in the range of 90 to 160 degrees, said cavity having an approximately cylindrical outer wall in the periphery thereof, said outer wall of said cavity having an upper end with the inner diameter approximately equal to:

[the outer diameter of the leg of the rivet+(the thickness of the workpiece adjacent to the die×4)]; and said cavity having a curved inner surface extending from the top of said central raised portion to the lower end of said outer wall through the bottom of said cavity.

2. The die as defined in claim 1, wherein said central raised portion has a top formed in a spherical shape.

3. The die as defined in claim 1, wherein the upper end of said outer wall of said cavity has a very small bevel or radius.

4. The die as defined in claim 1, wherein the upper end of said outer wall of said cavity has an inner diameter equal to:

[the outer diameter of the leg of the rivet+(the thickness of the workpiece adjacent to the die×4)] ±10%.

5. A self-piercing rivet setting apparatus having a punch and a die which are operable to drive a self-piercing rivet into a plurality of workpieces positioned between the punch and the die, said self-piercing rivet having a large-diameter head and a hollow leg extending downward from said head, wherein when said self-piercing rivet is driven into said workpieces, said leg of said self-piercing rivet is driven to pierce said workpieces while allowing a front end of said leg to be expandingly deformed in its radially outward direction and to be retained in said workpieces without passing therethrough, so as to connect said plurality of workpieces with each other by said expanded leg and said head, said apparatus being characterized in that:

said die includes a cavity for receiving therein a protruded workpiece zone consisting of respective portions of said workpieces to be protrudingly deformed toward said die through the pressure of said self-piercing rivet pressed by said punch, wherein said cavity has a bottom surface provided with a central raised portion protruding from the center of the bottom surface toward a punch, said central raised portion of the cavity having a vertical angle in the range of 90 to 160 degrees, said cavity having an approximately cylindrical outer wall in the periphery thereof, said outer wall of said cavity having an upper end with the inner diameter approximately equal to:

[the outer diameter of the leg of the rivet+(the thickness of the workpiece adjacent to the die×4)], and said cavity having a curved inner surface extending from the top of said central raised portion to the lower end of said outer wall through the bottom of said cavity.

* * * * *